United States Patent [19]

West

[11] Patent Number: 4,944,204

[45] Date of Patent: Jul. 31, 1990

[54] PLIERS WITH ADJUSTABLE JAW MEANS

[76] Inventor: Roland J. West, 303 Ridgewood Dr., Mystic, Conn. 06355

[21] Appl. No.: 278,783

[22] Filed: Dec. 2, 1988

[51] Int. Cl.[5] ..... B25B 7/04

[52] U.S. Cl. ..... 81/385; 81/395; 81/420; 81/421

[58] Field of Search ..... 81/385–392, 81/329–341, 395–396, 324–328, 418–424, 424.5, 426, 426.5, 355–356

*Primary Examiner*—D. S. Meislin

*Attorney, Agent, or Firm*—Pearson & Pearson

[57] ABSTRACT

An adjustable jaw pliers wherein the adjustable jaw pliers have a quick release threaded rod positioning portion which engages the threaded rod which has a pliers jaw attached to one end of the threaded rod. The pliers jaw which is attached to the threaded rod can be positioned at any distance from the other pliers jaw of the pliers by disengaging the threaded rod laterally from the quick release threaded rod positioning portion of the pliers. The pliers handle containing the quick release threaded rod positioning portion has a locking device attached to the pivot pin of the pliers. The locking device locks the threaded rod into the quick release threaded rod positioning portion of the pliers. Another aspect of the adjustable jaw pliers has the threaded rod attached to one of the pliers handle portions and a quick release adjustable position pliers jaw is positioned laterally to the threaded rod to and locked into place by a locking device.

An additional aspect of the adjustable pliers is that the pliers provide a quick and easy means of applying a spreading force between two surfaces by relocating the adjustable jaws.

15 Claims, 3 Drawing Sheets

Fig. 1
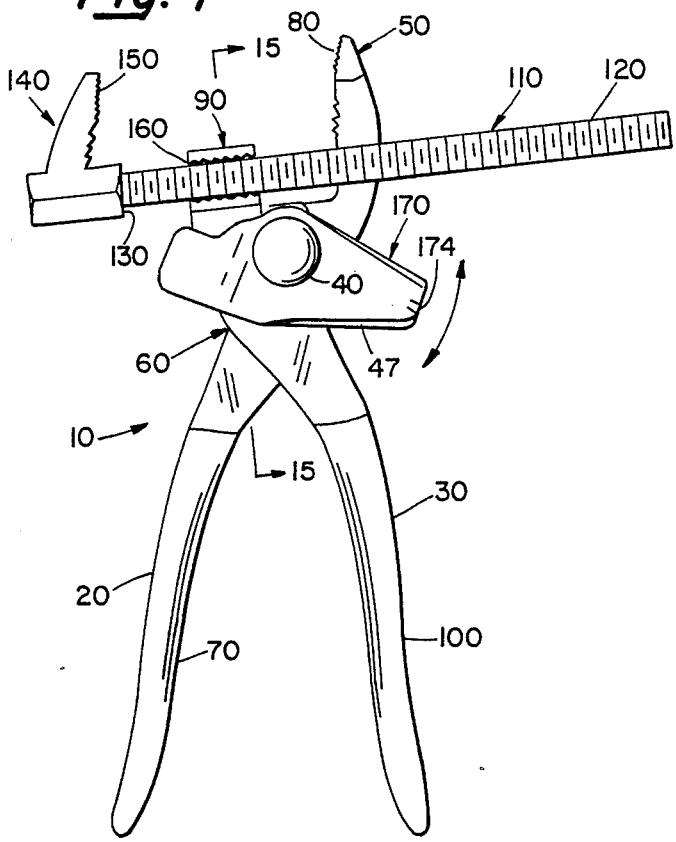
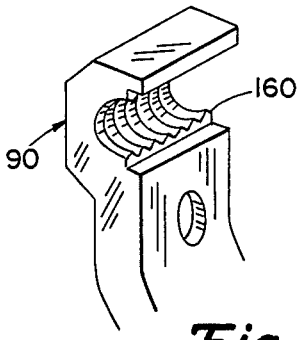
Fig. 2
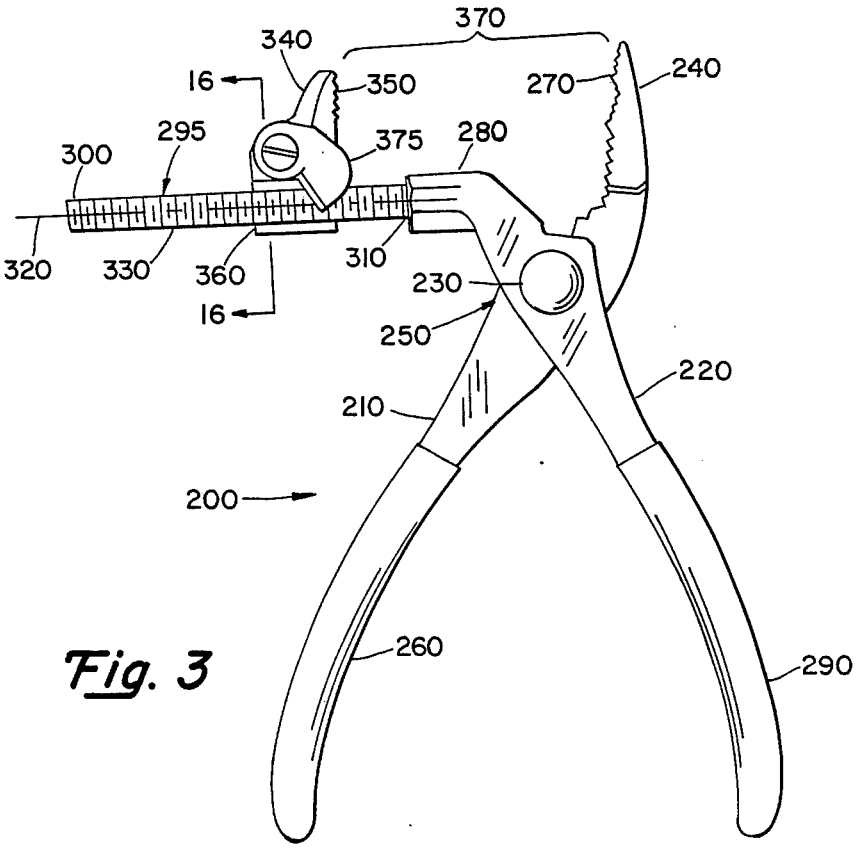
Fig. 3

Fig. 4
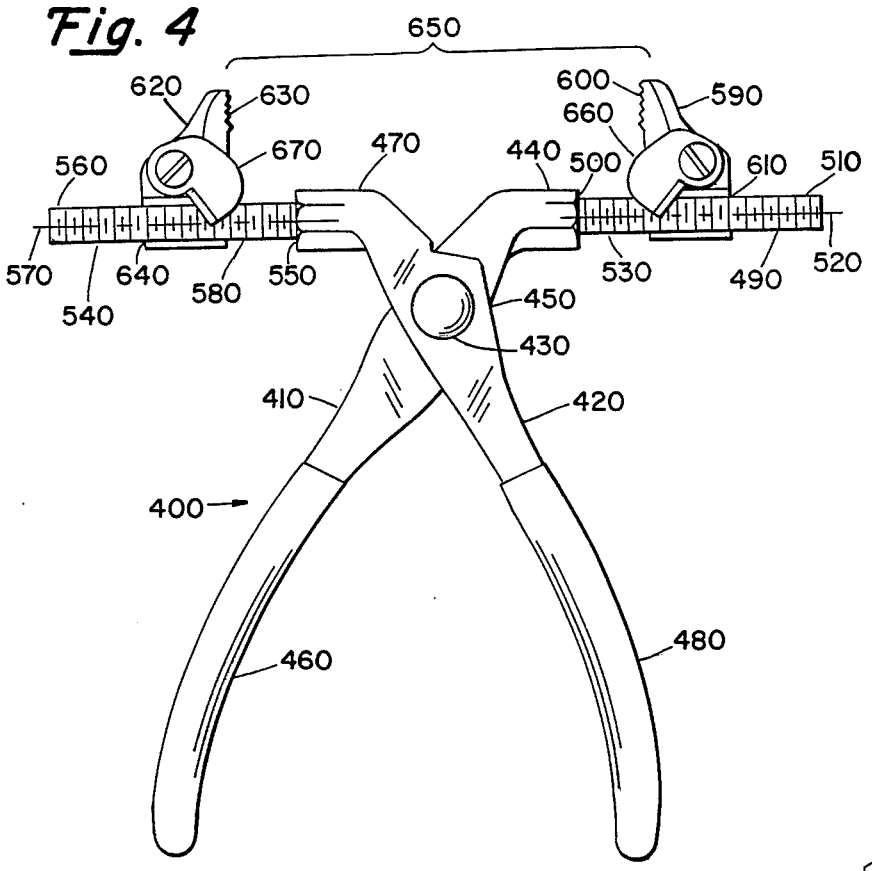
Fig. 6
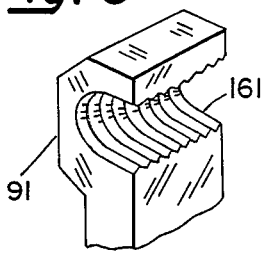
Fig. 7
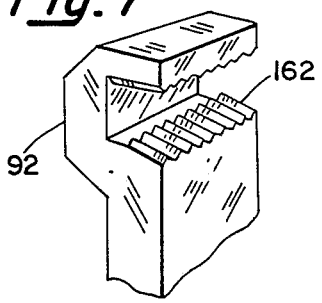
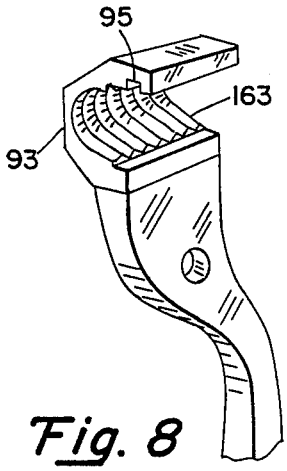
Fig. 8
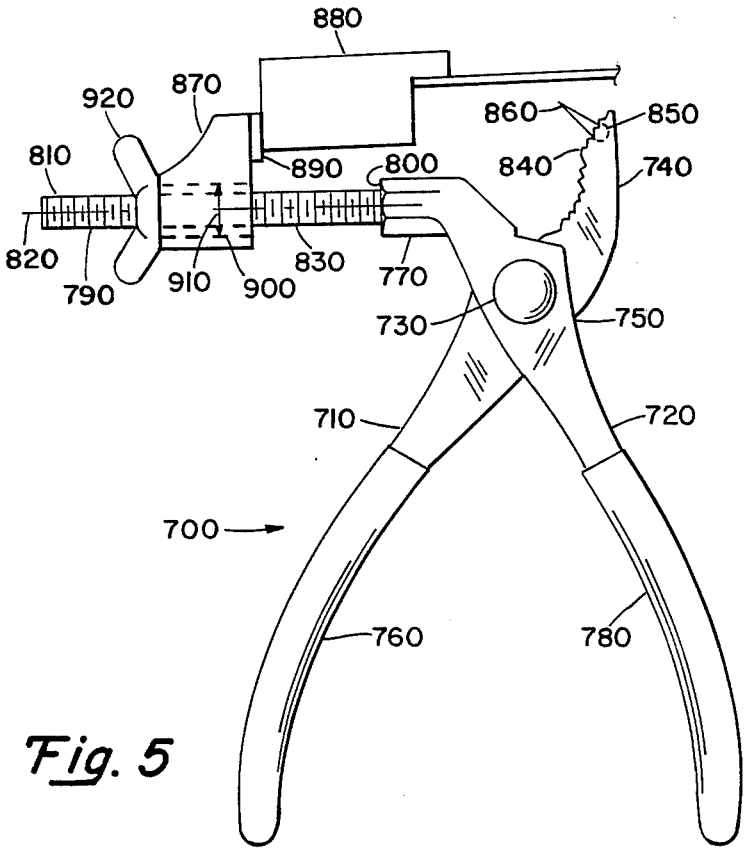
Fig. 5
Fig. 9
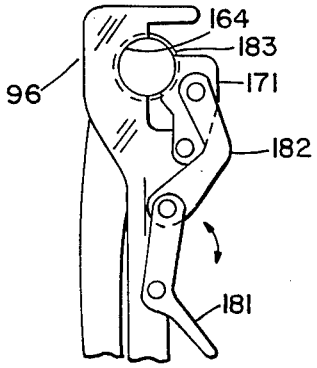

PLIERS WITH ADJUSTABLE JAW MEANS

FIELD OF THE INVENTION

The present invention relates to tools. More particularly, the present invention relates to an adjustable pliers.

BACKGROUND OF THE INVENTION

Adjustable jaw tools are well known in the prior art. U.S. Pat. No. 54,820 to Page discloses an adjustable jaw which is screwed into desired position as shown in the drawing. U.S. Pat. No. 102,690 to Lynch discloses another adjustable jaw as shown in FIG. 1. U.S. Pat. No. 186,575 to Jessop discloses another variation of an adjustable jaw having a tubular internally screw threaded block as shown in FIG. 1. U.S. Pat. No. 190,330 to Jarecki discloses a head having a hole with female screw threads through which a bit is screwed and adjusted to any size pipe desired as shown in FIG. 1. U.S. Pat. No. 593,042 to Birtch discloses another variation of an adjustable jaw in which the distance between the jaws is regulated by turning an adjusting screw as shown in FIGS. 1 and 2. U.S. Pat. No. 2,197,128 to Harrison discloses a quick acting clamp structure which includes a ratchet and pawl as well as a screw, a clamping nut and a jaw element as shown in FIG. 1. U.S. Pat. No. 2,447,199 to Miller discloses a toggle link operated hand clamp which has a coil spring which surrounds a screw and a pair of substantially L-shaped links, and a pull arm coacting to upwardly close the jaws as shown in FIG. 2. U.S. Pat. No. 2,617,458 to Kelley discloses adjustable jaws in FIG. 1. U.S. Pat. No. 4,289,050 to Scafaro discloses an expansion tool having adjustable jaws as shown in the drawing. U.S. Pat. No. 4,563,921 to Wallace discloses a compact pliers with large adjustable jaw span as shown in the drawing and U.S. Pat. No. 4,581,960 to Putsch et al. discloses a water pump pliers which can have the distance between the jaws adjusted as shown in the drawing.

The prior art tools are in general limited to the extent of adjustment which can be made to the distance between the jaws.

SUMMARY OF THE INVENTION

A first embodiment of the present invention is a novel and improved adjustable jaw pliers. The adjustable jaw pliers comprise a pair of pliers which have a first pliers handle and a second pliers handle. The first pliers handle and the second pliers handle cross with respect to each other, traversing one within the other and are connected together with respect to one another by a pivot pin.

The first pliers handle forms a first pliers jaw above the crossing region of the first pliers handle and the second pliers handle. The first pliers handle forms a first grip portion below the crossing region. The first pliers jaw has a first work engaging surface.

The second pliers handle forms a quick release threaded rod positioning portion above the crossing region and the second pliers handle forms a second grip portion below the crossing region.

A threaded rod has male threads and an end coupled to a second pliers jaw and is coupled to the quick release threaded rod positioning means.

The second pliers jaw has a second work engaging surface disposed in opposed cooperating relationship and is essentially parallel to the first work engaging surface of the first pliers jaw.

The threaded rod is essentially perpendicular to the first work engaging surface of the first pliers jaw and the second work engaging surface of the second pliers jaw.

The quick release threaded rod positioning means has partial internal female threads for engaging a portion of the male threads of the threaded rod. The quick release threaded rod positioning means is adapted to engage and disengage the threaded rod to reposition the threaded rod to change the distance between the first work engaging surface of the first pliers jaw and the second work engaging surface of the second pliers jaw.

The first pliers jaw is adapted to provide clearance for the threaded rod to extend from the quick release threaded rod positioning means past the first pliers jaw, and the pair of pliers has a locking means for locking the threaded rod into the quick release threaded rod positioning means. The locking means is connected to the pivot pin of the pair of pliers, the locking means pivots on the pivot pin to engage the quick release threaded rod positioning means.

A second embodiment of the present invention is a novel and improved adjustable jaw pliers which comprise a pair of pliers which have a first pliers handle and a second pliers handle. The first pliers handle and the second pliers handle cross with respect to each other, traversing one within the other and are connected together with respect to one another by a pivot pin.

The first pliers handle forms a first pliers jaw above the crossing region of the first pliers handle and the second pliers handle. The first pliers handle forms a first grip portion below the crossing region. The first pliers jaw has a first work engaging surface.

The second pliers handle forms a quick release threaded rod positioning portion above the crossing region and the second pliers handle forms a second grip portion below the crossing region.

A threaded rod has a first end, a second end, a major axis, and male threads. The second end of the threaded rod is coupled to the threaded rod support portion. The threaded rod is essentially perpendicular to the first work engaging surface of the first pliers jaw and is extending from the threaded rod support portion away from the first pliers jaw.

A quick release adjustable position pliers jaw has a work engaging surface and partial internal female threads and is adapted to couple to the threaded rod to change the distance between the first work engaging surface of the first pliers jaws and the second work engaging surface of the quick release adjustable position pliers jaw.

The partial internal female threads of the quick release adjustable position pliers jaw coacts with a portion of the male threads of the threaded rod at any position along the major axis of the threaded rod.

The quick release adjustable position pliers has a locking means for locking the quick release adjustable portion pliers jaw on the threaded rod.

A third embodiment of the present invention is a novel and improved adjustable jaw pliers which comprise a pair of pliers which have a first pliers handle and a second pliers handle. The first pliers handle and the second pliers handle cross with respect to each other, traversing one within the other and are connected together with respect to one another by a pivot pin.

The first pliers handle forms a first threaded rod support portion above the crossing region of the first pliers handle and the second pliers handle. The first pliers handle forms a first grip portion below the crossing region.

The second pliers handle forms a second threaded rod support portion above the crossing region and the second pliers handle forms a second grip portion below the crossing region.

A first threaded rod has a first end, a second end, a major axis, and male threads. The first end is coupled to the first threaded rod support portion.

A second threaded rod has a first end, a second end, a major axis, and male threads. The first end is coupled to the second threaded rod support portion.

A first quick release adjustable position pliers jaw has a first work engaging surface and a first partial internal female threads and is coupled to the first threaded rod or to the second threaded rod.

A second quick release adjustable position pliers jaw has a second work engaging surface and a second partial internal female threads and is coupled to the first threaded rod or the second threaded rod.

The first threaded rod is essentially perpendicular to the first work engaging surface of the first quick release adjustable position pliers jaw and to the second work engaging surface of the second quick release adjustable position pliers jaw.

The first quick release adjustable position pliers jaw is adapted to engage the first threaded rod or the second threaded rod at any position along the major axis of the first threaded rod or the second threaded rod to change the distance between the first work engaging surface of the first quick release adjustable position pliers jaw and the second work engaging surface of the second quick release adjustable position pliers jaw.

The first quick release adjustable position pliers jaw has a locking means for locking the first quick release adjustable position pliers jaw on the first threaded rod or the second threaded rod, and the second quick release adjustable position pliers jaw has a locking means for locking the second quick release adjustable position pliers jaw on the first threaded rod or the second threaded rod.

A fourth embodiment of the present invention is a novel and improved picture frame brad driver which comprises a pair of pliers which have a first pliers handle and a second pliers handle. The first pliers handle and the second pliers handle cross with respect to each other, traversing one within the other and are connected together with respect to one another by a pivot pin.

The first pliers handle forms a first pliers jaw above the crossing region of the first pliers handle and the second pliers handle. The first pliers handle forms a first grip portion below the crossing region.

The second pliers handle forms a second threaded rod support portion above the crossing region and the second pliers handle forms a second grip portion below the crossing region.

A threaded rod has a first end, a second end, a major axis, and male threads. The first end is coupled to the threaded rod support portion of the second pliers handle of the pair of pliers.

The first pliers jaw has a first work engaging surface containing a brad receiving means for holding a brad in position.

An adjustable position frame gripping means for gripping a picture frame is in line with the brad positioned in the brad receiving means of the first pliers jaw.

The adjustable position frame gripping means has a second work engaging surface and an aperture which has a diameter sufficient to clear the male threads of the threaded rod.

The adjustable position frame gripping means is positioned on the threaded rod. The second work engaging surface is essentially perpendicular to the major axis of the threaded rod.

The adjustable position frame gripping means is positioned on the threaded rod by a threaded positioning means.

The first plier jaw containing the brad provides a compressive force to the brad sufficient to engage the brad into the picture frame.

BRIEF DESCRIPTION OF THE DRAWING

The various objects, advantages, and novel features will be more fully apparent from a reading of the following detailed description when read in connection with the accompanying drawing, in which like numerals refer to like parts, and in which:

FIG. 1 is a side elevational view of an improved adjustable jaw pliers in accordance with the present invention.

FIG. 2 is a partial prospective view of quick release threaded rod positioning means 90 shown in FIG. 1 in accordance with the present invention.

FIG. 3 is a side elevational view of another aspect of an improved adjustable jaw pliers in accordance with the present invention.

FIG. 4 is a side elevational view of another aspect of an improved adjustable jaw pliers in accordance with the present invention.

FIG. 5 is a side elevational view of an improved picture frame brad driver in accordance with the present invention.

FIG. 6 is a partial perspective view of another variation of quick release threaded rod positioning means 90 shown in FIG. 2 in accordance with the present invention.

FIG. 7 is a partial perspective view of another variation of quick release threaded rod positioning means 90 shown in FIG. 2 in accordance with the present invention.

FIG. 8 is a partial perspective view of another variation of quick release threaded rod positioning means 90 shown in FIG. 2 in accordance with the present invention.

FIG. 9 is a partial side elevational view of another variation of quick release threaded rod positioning means 90 shown in FIG. 2 in accordance with the present invention.

DETAILED DESCRIPTION OF THE PREFERRED EMBODIMENTS

Figure 10:
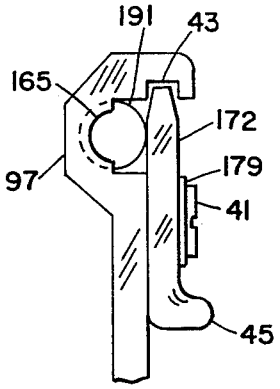
FIG. 10 is a partial side elevational view of another variation of quick release threaded rod positioning means 90 shown in FIG. 2 in accordance with the present invention.

Referring now to the drawing with greater particularity, there is shown in FIG. 1 adjustable jaw pliers 10. Adjustable jaw pliers 10 comprise a pair of pliers which have first pliers handle 20 and second pliers handle 30. First pliers handle 20 and second pliers handle 30 cross with respect to each other, traversing one within the other and are connected together with respect to one another by pivot pin 40.

First pliers handle 20 forms first pliers jaw 50 above crossing region 60 of first pliers handle 20 and second pliers handle 30. First pliers handle 20 forms first grip portion 70 below crossing region 60. First pliers jaw 50 has first work engaging surface 80.

Second pliers handle 30 forms quick release threaded rod positioning means 90 above crossing region 60 and second handle 30 forms second grip portion 100 below crossing region 60.

Threaded rod 110 has male threads 120 and end 130. Second pliers jaw 140 is attached to end 130 of threaded rod 110. Threaded rod 110 is coupled to quick release threaded rod positioning means 90.

Second pliers jaw 140 has second work engaging surface 150 disposed in opposed cooperating relationship and is essentially parallel to first work engaging surface 80 of first pliers jaw 50.

Threaded rod 110 is essentially perpendicular to first work engaging surface 80 of the first pliers jaw 50 and second work engaging surface 150 of second pliers jaw 140.

Quick release threaded rod positioning means 90 has partial internal female threads 160, shown in FIG. 2, for engaging a portion of male threads 120 of threaded rod 110. Quick release threaded rod positioning means 90 is adapted to engage and disengage threaded rod 110 to reposition threaded rod 110 to change the distance between first work engaging surface 80 of first pliers jaw 50 and second work engaging surface 150 of second pliers jaw 140.

First pliers jaw 50 is offset from the pivot pin 40 to provide clearance for threaded rod 110 to extend from quick release threaded rod positioning means 90 past first pliers jaw 50, and adjustable jaw pliers 10 has locking means 170 for locking threaded rod 110 into quick release threaded rod positioning means 90. Locking means 170 is connected to pivot pin 40 to engage quick release threaded rod positioning means 90. In FIG. 1 locking means 170 is in open position to receive threaded rod 110. When the locking means is pivoted to locking position, means 170 is adjacent to release threaded rod positioning means 90, so that threaded rod 110 is locked in place.

Shown in FIG. 3 is adjustable jaw pliers 200 which comprise a pair of pliers which have first pliers handle 210 and second pliers handle 220. First pliers handle 210 and second pliers handle 220 cross with respect to each other, traversing one within the other and are connected together with respect to one another by a pivot pin 230.

First pliers handle 210 forms first pliers jaw 240 above crossing region 250 of first pliers handle 210 and second pliers handle 220. First pliers handle 210 forms first grip portion 260 below crossing region 250. First pliers jaw 240 has first work engaging surface 270.

Second pliers handle 220 forms threaded rod support portion 280 above crossing region 250 and second pliers handle forms second grip portion 290 below crossing region 250.

Threaded rod 295 has first end 300, second end 310, major axis 320, and male threads 330. Second end 310 of threaded rod 295 is coupled to threaded rod support portion 280. Threaded rod 295 is extending from threaded rod support portion 280 away from first pliers jaw 240.

Quick release adjustable position pliers jaw 340 has second work engaging surface 350 and partial internal female threads 360 and is adapted to couple to threaded rod 295 to change distance 370 between first work engaging surface 270 of first pliers jaw 240 and second work engaging surface 350 of quick release adjustable position pliers jaw 340.

Partial internal female threads 360 of quick release adjustable position pliers jaw 340 coacts with a portion of male threads 330 of threaded rod 290 at any position along major axis 320 of threaded rod 290.

Quick release adjustable position pliers jaw 340 has locking means 375 which pivots on jaw 340 for locking quick release adjustable position pliers jaw 340 on threaded rod 290.

Shown in FIG. 4 is adjustable jaw pliers 400 which comprise a pair of pliers which have first pliers handle 410 and second pliers handle 420. First pliers handle 410 and second pliers handle 420 cross with respect to each other, traversing one within the other and are connected together with respect to one another by pivot pin 430.

First pliers handle 410 forms first threaded rod support portion 440 above crossing region 450 of first pliers handle 410 and second pliers handle 420. First pliers handle 410 forms first grip portion 460 below crossing region 450.

Second pliers handle 420 forms second threaded rod support portion 470 above crossing region 450 and second handle forms second grip portion 480 below crossing region 450.

First threaded rod 490 has first end 500, second end 510, major axis 520, and male threads 530. First end 500 is coupled to first threaded rod support portion 440.

Second threaded rod 540 has first end 550, second end 560, major axis 570, and male threads 580. First end 550 is coupled to second threaded rod support portion 470.

First quick release adjustable position pliers jaw 590 has first work engaging surface 600 and first partial internal female threads 610 and is coupled to first threaded rod 490 or to second threaded rod 540.

Second quick release adjustable position pliers jaw 620 has second work engaging surface 630 and second partial internal female threads 640 and is coupled to first threaded rod 490 or second threaded rod 540.

First threaded rod 490 is essentially perpendicular to first work engaging surface 600 of first quick release adjustable position pliers jaw 590 and to second work engaging surface 630 of second quick release adjustable position pliers jaw 620.

First quick release adjustable position pliers jaw 590 is adapted to engage first threaded rod 490 or second threaded rod 540 at any position along major axis 520 of first threaded rod 490 or major axis 570 of second threaded rod 540 to change distance 650 between first work engaging surface 600 of first quick release adjustable position pliers 590 and second work engaging surface 630 of second quick release adjustable position pliers jaw 620.

First quick release adjustable position pliers jaw 590 has locking means 660 for locking first quick release adjustable position pliers jaw 590 on first threaded rod 490 or second threaded rod 540, and second quick release adjustable position pliers jaw 620 has locking means 670 for locking second quick release adjustable position pliers jaw 620 on first threaded rod 490 or second threaded rod 540.

Shown in FIG. 5 is a picture frame brad driver 700 which comprises a pair of pliers which have first pliers handle 710 a second pliers handle 720. First pliers handle 710 and second pliers handle 720 cross with respect to each other, traversing one within the other and are connected together with respect to one another by pivot pin 730.

First pliers handle 710 forms first pliers jaw 740 above crossing region 750 of first pliers handle 710 and second pliers handle 720. First pliers handle 710 forms first grip portion 760 below crossing region 750.

Second pliers handle 720 forms second threaded rod support portion 770 above crossing region 750 and second pliers handle 720 forms second grip portion 780 below crossing 750.

Threaded rod 790 has first end 800, second end 810, major axis 820 and male threads 830. First end 800 is coupled to second threaded rod support portion 770 of second pliers handle 720 of the pair of pliers.

First pliers jaw 740 has first work engaging surface 840 containing brad receiving means 850 for holding brad 860 in position.

Adjustable position frame gripping means 870 for gripping picture frame 880 is in line with brad 860 positioned in brad receiving means 850 of first pliers jaw 740.

Adjustable position frame gripping means 870 has second work engaging surface 890 and aperture 900 which has diameter 910 sufficient to clear male threads 830 of threaded rod 790.

Adjustable position frame gripping means 870 is positioned on threaded rod 790 by threaded positioning means 920.

First pliers jaw 740 containing brad 860 provides a compressive force to brad 860 sufficient to engage brad 860 into picture frame 880.

An important feature of the pliers of this invention is that the adjustable jaw positioning means provides an unlimited range of the "pinch" or "spread" distance between the jaws while retaining the feel, strength and force or ordinary pliers.

Another important feature of the pliers of this invention is that they provide a quick and easy means of applying a spreading force between two surfaces by relocating the adjustable jaw shown in FIG. 1. The distance between the jaws may be increased with additional sections of the threaded rod. This invention has the feature of utilizing standard threaded rods and couplings readily available.

The special feature that makes this invention both functional and unique is the partially threaded portion of the quick release threaded rod positioning means or the quick release position pliers jaw. The partially threaded portion of the quick release threaded rod positioning means or the quick release position pliers jaw provides an opening to receive and engage the threaded rod laterally which allows the threaded rod to be placed in the partially threaded portion of the quick release threaded rod positioning means or the quick release position pliers jaw at any position along its length to form a firm connection. The connection will hold securely and with full strength as long as the threaded rod is not allowed lateral movement so as to disengage the threads even though only a portion of the threads of the threaded rod engage the partially threaded portion of the quick release threaded rod positioning means or the quick release position pliers jaw.

Variations of the thread configurations such as threads 161 of quick release threaded rod positioning means 91 having a combination of both straight and circular threads shown in FIG. 6 and threads 162 made by the hobbing process which is a generating process, employs a number of straight sided rack teeth wrapped helically around a cylindrical body, of quick release threaded rod positioning means 92 shown in FIG. 7 will provide further assurance that the threaded rod will not escape because the threads 162 will engage the threads on the threaded rod even if the locking means was either badly worn or bent.

Figure 11:
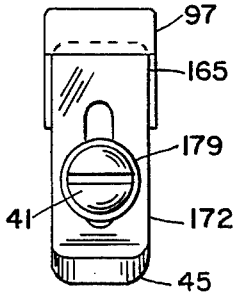
FIG. 11 is a partial front elevational view of the quick release threaded rod positioning means shown in FIG. 10 in accordance with the present invention.
Figure 12:
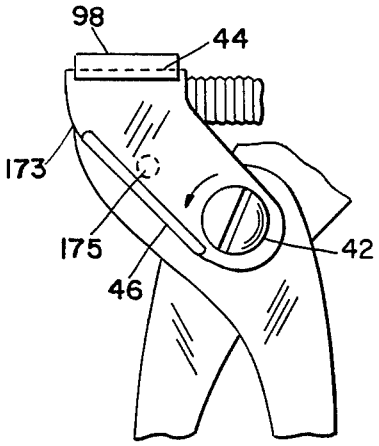
FIG. 12 is a partial side elevational view of another variation of quick release threaded rod positioning means 90 shown in FIG. 2 in accordance with the present invention.

Another variation of the invention is the lip above the threaded section such as lip 95 shown in FIG. 8 of quick release threaded rod positioning means 93 having partial circular threads 163, or lip 43 shown in FIG. 10 of quick release threaded rod positioning means 97, or lip 44 shown in FIG. 12 of quick release threaded rod positioning means 98 that receives the end of the locking means such as locking means 172 shown in FIGS. 10 and 11 and locking means 173 shown in FIG. 12 which passes under this lip giving both strength and true alignment. This locks the threaded rod more securely. The locking means can also have a detent such as detent 174 shown in FIG. 1 and detent 175 shown in FIG. 12 to hold it in the closed position as well as a thumb tab for the ease of operation such as thumb tab 45 shown in FIGS. 10 and 11, thumb tab 46 shown in FIG. 12.

Shown in FIG. 9 is quick release threaded rod positioning means 96 which comprises locking means 171 having a toggle action. Pivoting member 181 having a lever coacts with pivoting member 182 which coacts with locking means 171 to lock threaded rod 183 against internal female threads 164 of quick release threaded rod positioning means 96.

Shown in FIGS. 10 and 11 is quick release threaded rod positioning means 97 having a locking means 172 which slides into lip 43 and held into place by fastener 41 and soft washer 179. Locking means 172 locks threaded rod 191 against internal female threads 165 when locking means 172 is slid into position by thumb tab 45.

Shown in FIG. 12 is locking means 173 which coacts with lip 44 of quick release threaded rod positioning means 98 when pivoted into place on pivot pin 42, such as a threaded fastener by hand application of thumb tab 46. Once in position detent 175 coacts with quick release threaded rod positioning means 98 to lock locking means 173 into place.

Shown in FIG. 1 is locking means 170 which pivots on pivot pin 40 by hand application of thumb tab 47 to lock threaded rod 110 into and engaging partial internal female threads 160 of quick release threaded rod positioning means 90. Once in position detent 174 coacts with quick release threaded rod positioning means 90 to lock locking means 170 into place.

Figure 13:
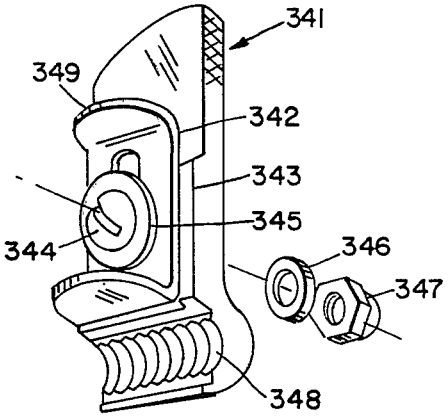
FIG. 13 is a perspective view of another variation of quick release adjustable position pliers jaw 340 shown in FIG. 3 and quick release adjustable position pliers jaw 590 and 620 shown in FIG. 4 with the present invention.

Shown in FIG. 13 is a quick release adjustable position pliers jaw 341 a variation of quick release adjustable position pliers jaw 340 shown in FIG. 3. Quick release adjustable position pliers jaw 341 has locking means 342, such as a slotted slide keeper, slide guide ridge 343, fastener 344, wear washer 345, soft washer 346 and stop nut 347. Locking means 342 is slid over the opening containing the partial female circular threads 348 by thumb tab 349 to secure and lock quick release adjustable position pliers jaw 341 into a given position of threaded rod 290 shown in FIG. 3.

Figure 14:
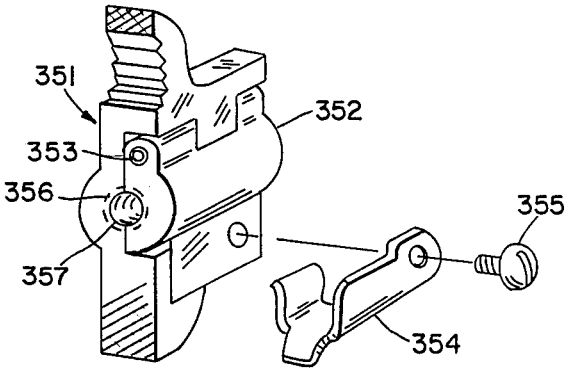
FIG. 14 is a perspective view of another variation of quick release adjustable position pliers jaw 340 shown in FIG. 3 and quick release adjustable position pliers jaw 590 and 620 shown in FIG. 4 in accordance with the present invention.
Figure 15:
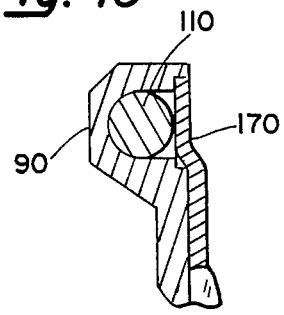
FIG. 15 is a cross sectional view taken along line 15—15 of FIG. 1 showing the locking piece in its locking position and the quick release threaded rod positioning means 90 as it cooperates with the threaded rod and the appropriate locking means.
Figure 16:
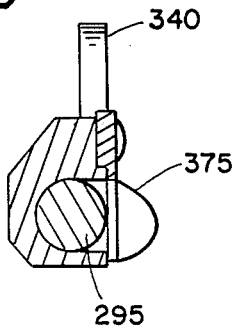
FIG. 16 is a cross sectional view taken along line 16—16 of FIG. 3, the quick release adjustable position pliers jaw 340 as it cooperates with the threaded rod and the appropriate locking means.

Shown in FIG. 14 is quick release adjustable position pliers jaw 351 which has locking means 352 which pivots about pivot pin 353 and is locked into place by pivoting locking member 354 which coacts with quick release adjustable position pliers jaw 351 by pivoting about pivot fastener 355. Both quick release adjustable position pliers jaw 351 and locking means 352 have partial internal female threads 356 and 357 respectively which engage threaded rod 295 shown in FIG. 3 or threaded rods 490 and 580 shown in FIG. 4.

While there has been shown and described what is at present considered the preferred embodiments of the invention, it will be obvious to those of ordinary skill in the art that various changes and modifications may be made therein without departing from the scope of the invention as defined by the appended claims.

I claim:

1. Adjustable jaw pliers comprising a pair of pliers having a first pliers handle and a second pliers handle, said first pliers handle and said second pliers handle crossing with respect to each other, traversing one within the other and being connected together with respect to one another by a pivot pin, said first pliers handle forming a first pliers jaw above the crossing region of said first pliers handle and said second pliers handle, said first pliers handle forming a first grip portion below said crossing region, said second pliers handle forming a quick release threaded rod positioning means above said crossing region and said second pliers handle forming a second grip portion below said crossing region, said first pliers jaw having a first work engaging surface, a threaded rod having male threads and an end coupled to a second pliers jaw and being coupled to said quick release threaded rod positioning means, said second pliers jaw having a second work engaging surface being disposed in opposed cooperating relationship and essentially parallel to said first work engaging surface of said first pliers jaw, said thread rod being essentially perpendicular to said first work engaging surface of said first pliers jaw and said second work engaging surface of said second pliers jaw, said quick release threaded rod positioning means having partial internal female threads for engaging a portion of said male threads of said threaded rod, said quick release threaded rod positioning means engages and disengages said threaded rod to reposition said threaded rod to change the distance between said first work engaging surface of said first pliers jaw and said second work engaging surface of said second pliers jaw, said first pliers jaw includes a clearance space for said threaded rod to extend from said quick release threaded rod positioning means past said first pliers jaw, and said pair of pliers having a locking means for locking said threaded rod into said quick release threaded rod positioning means, said locking means being connected to said pivot pin of said pair of pliers, said locking means pivoting on said pivot pin to engage said quick release threaded rod positioning means.

2. Adjustable jaw pliers in accordance with claim 1 wherien said quick release threaded rod positioning means has a lip for receiving said locking means.

3. Adjustable jaw pliers in accordance with claim 1 wherein said locking means has a detent for coacting with said second pliers handle to position and lock said locking means over said threaded rod engaged with said internal partial female threads of said quick release threaded rod positioning means.

4. Adjustable jaw pliers in accordance with claim 1 wherein said quick release threaded rod positioning means comprises a locking means which has a toggle action, said locking means comprises a pivoting member having a lever which coacts with another pivoting member which coacts with locking means which locks said threaded rod against and engaging said partial internal female threads of said quick release threaded rod positioning means.

5. Adjustable jaw pliers in accordance with claim 1 wherein said quick release threaded rod positioning means comprises a locking means which slides into a lip of said quick release threaded rod positioning means locking said threaded rod against and engaging said partial internal female threads of said quick release threaded rod positioning means.

6. Adjustable jaw pliers in accordance with claim 1 wherein said partial internal threads of said quick release threaded rod positioning means comprise a combination of straight and circular threads.

7. Adjustable jaw pliers in accordance with claim 1 wherein said partial internal threads of said quick release threaded rod positioning means comprise threads made by the hobbing, forging, or machining.

8. Adjustable jaw pliers comprising:

a pair of pliers having a first pliers handle and a second pliers handle, said first pliers handle and said second pliers handle crossing with respect to each other, traversing one within the other and being connected together with respect to one another by a pivot pin, said first pliers handle forming a first pliers jaw above the crossing region of said first pliers handle and said second pliers handle, said first pliers handle forming a first grip portion below said crossing region, said second pliers handle forming a threaded support portion above said crossing region and said second pliers handle forming said first pliers jaw having a first work engaging surface, a threaded rod having a first end, a second end, a major axis, and male threads, said second end of said threaded rod being coupled to said threaded rod support portion, said threaded rod being essentially perpendicular to said first work engaging surface of said first pliers jaw and extending from said threaded rod support portion away from said first pliers jaw, a quick release adjustable position pliers jaw having a work engaging surface and partial internal female threads to couple said threaded rod to change the distance between said first work engaging surface of said first pliers jaw and said second work engaging surface of said quick release adjustable position pliers jaw, said partial internal female threads of said quick release adjustable position pliers jaw coacts with a portion of said male threads of said threaded rod at any position along said major axis of said threaded rod, and said quick release adjustable position pliers jaw having a locking means for locking said quick release adjustable position pliers jaw on said threaded rod.

9. Adjustable jaw pliers in accordance with claim 8 wherein said locking means slides over said threaded rod to lock quick release adjustable position pliers jaw to a given position on said threaded rod.

10. Adjustable jaw pliers in accordance with claim 8 wherein said quick release adjustable position pliers jaw comprises a locking means having a pivot pin and is locked into place by a pivoting locking member which coacts with said quick release adjustable position pliers jaw by pivoting about a pivot fastener, said quick release adjustable position pliers jaw and said locking means have partial internal female threads which engage said threaded rod and locks said quick release adjustable position pliers jaw to said threaded rod.

11. Adjustable jaw pliers in accordance with claim 8 wherein said locking means pivots on a pivot pin to lock said quick release adjustable position pliers jaw on said threaded rod.

12. Adjustable jaw pliers comprising:

a pair of pliers having a first plier handle and a second plier handle, said first pliers handle and said second pliers handle crossing with respect to each other, traversing one within the other and being connected together with respect to one another by a pivot pin, said first pliers handling forming a first threaded rod support portion above the crossing region of said first pliers handle and said second pliers handle, said first pliers handle forming a first grip portion below said crossing region, said second pliers handle forming a second threaded rod support portion above said crossing region and said second pliers handle forming a second grip portion below said crossing region, a first threaded rod having a first end, a second end, a major axis, and male threads, said first end being coupled to said first threaded rod support portion, a second threaded rod having a first end, a second end, a major axis, and male threads, said first end being coupled to said second threaded rod support portion, a first quick release adjustable position pliers jaw having a first work engaging surface and a first partial internal female threads and being coupled to one of said first threaded rod or to said second threaded rod, a second quick release adjustable position pliers jaw having a second work engaging surface and a second partial internal female threads and being coupled to the other of said first threaded rod or said second threaded rod, said first threaded rod being essentially perpendicular to said first work engaging surface of said first quick release adjustable position pliers jaw and to said second work engaging surface of said second quick release adjustable position pliers jaw, said first quick release adjustable position pliers jaw being adapted to engage said first threaded rod or said second threaded rod at any position along said major axis of said first threaded rod or said second threaded rod to change the distance between said first work engaging surface of said first quick release adjustable position pliers jaw and said second work engaging surface of said second quick release adjustable position pliers jaw, said first quick release adjustable position pliers jaw having a locking means for locking said first quick release adjustable position pliers jaw on said first threaded rod or said second threaded rod, and said second quick release adjustable position pliers jaw having a locking means for locking said second quick release adjustable position pliers jaw on said first threaded rod or said second threaded rod.

13. Adjustable jaw pliers in accordance with claim 12 wherein said locking means slides over said first or said second threaded rod to lock quick release adjustable position pliers jaw to a given position on said first or said second threaded rod.

14. Adjustable jaw pliers in accordance with claim 12 wherein said quick release adjustable position pliers jaw comprises a locking means which pivots about a pivot pin and is locked into place by a pivoting locking member which coacts with said quick release adjustable position pliers jaw by pivoting about a pivot fastener, said quick release adjustable position pliers jaw and said locking means have partial internal female threads which engage said first or said second threaded rod and locks said quick release adjustable position pliers jaw to said first or said second threaded rod.

15. Adjustable jaw pliers in accordance with claim 12 wherein said locking means pivots on a pivot pin to lock said quick release adjustable position pliers jaw on said first or said second threaded rod.

* * * * *